US011089869B2

(12) United States Patent
Robinson

(10) Patent No.: US 11,089,869 B2
(45) Date of Patent: Aug. 17, 2021

(54) RECORD HOLDER SYSTEM AND METHOD

(71) Applicant: Richard Drake Robinson, Austin, TX (US)

(72) Inventor: Richard Drake Robinson, Austin, TX (US)

( * ) Notice: Subject to any disclaimer, the term of this patent is extended or adjusted under 35 U.S.C. 154(b) by 0 days.

(21) Appl. No.: 16/695,439

(22) Filed: Nov. 26, 2019

(65) Prior Publication Data

US 2021/0153648 A1 May 27, 2021

(51) Int. Cl.
*A47B 81/06* (2006.01)
*A47B 57/58* (2006.01)

(52) U.S. Cl.
CPC ..... *A47B 81/067* (2013.01); *A47B 57/583* (2013.01)

(58) Field of Classification Search
CPC ..... A47L 81/067; A47L 65/10; A47L 65/15; A47L 65/20; G11B 33/04
See application file for complete search history.

(56) References Cited

U.S. PATENT DOCUMENTS 497,993 A * 5/1893 Thomson ..... B42F 17/02 211/51
1,290,512 A * 1/1919 Coleman ..... B42F 17/02 211/51
1,460,642 A * 7/1923 Cadenhead ..... A47B 65/20 211/43
1,674,582 A * 6/1928 Wheeler ..... A47B 57/583 211/43
1,772,438 A * 8/1930 Cubberley ..... A47B 57/583 211/11
2,020,514 A * 11/1935 Moffitt ..... A47B 65/10 211/51
2,051,448 A * 8/1936 Johnson ..... A47B 65/00 211/43
2,060,146 A * 11/1936 Voorhees ..... B42F 17/02 312/273
2,134,606 A * 10/1938 Hackworth ..... A47B 65/15 108/27
2,206,133 A * 7/1940 Stoll ..... A47B 65/00 211/43
2,264,017 A * 11/1941 Bowmen ..... A47B 65/10 108/28
2,534,456 A * 12/1950 Kudrikoff ..... A47B 65/10 211/43

(Continued)

FOREIGN PATENT DOCUMENTS

DE 29608182 U1 * 9/1996 ..... A47B 57/585
FR 359275 A * 3/1906 ..... A47B 65/10

(Continued)

*Primary Examiner* — Stanton L Krycinski
(74) *Attorney, Agent, or Firm* — The Law Firm of H. Dale Langley, Jr., PC

(57) ABSTRACT

A record holder system includes a frame of two ends and two sides, a fixed end attached to one of the ends of the frame, and a selectively adjustable end slidably connected to the frame. The frame connects to a track. The adjustable end includes a clamp that engages the track to retain the adjustable end in select position along the track. A handle connects to the clamp. The handle is manually pressed to disengage the clamp from the track, thereby allowing the adjustable end to be varied in relative position with respect to the fixed end. Records or other items may be stacked upright and retained in the system.

6 Claims, 8 Drawing Sheets

(56) References Cited

U.S. PATENT DOCUMENTS 2,545,844 A * 3/1951 Cougias ..... A47B 65/00 211/43
2,620,929 A * 12/1952 Sportsman ..... A47B 65/15 108/28
2,908,394 A * 10/1959 Thoweman ..... G11B 33/0433 211/40
2,911,103 A * 11/1959 Kunkler ..... A47B 65/10 211/43
3,052,507 A 9/1962 Wallach
3,107,816 A 10/1963 Teagu, Jr. et al.
3,318,454 A * 5/1967 Donlin ..... A47B 65/10 211/43
3,389,805 A * 6/1968 Yeomans ..... A47B 65/10 211/43
3,487,945 A * 1/1970 Barham ..... B62B 3/005 211/43
3,679,064 A * 7/1972 Howkinson ..... A47B 65/10 211/43
3,779,621 A 12/1973 Carless
3,889,812 A * 6/1975 Gutierrez ..... A47B 81/067 211/1.51
4,082,385 A 4/1978 Morrone
4,236,768 A 12/1980 Morrone
4,241,955 A 12/1980 Armistead
4,305,510 A 12/1981 Eppy
4,620,740 A 11/1986 Kinzig
4,655,345 A 4/1987 Drake et al.
4,682,696 A * 7/1987 Sheu ..... A47B 65/20 211/43
5,161,700 A * 11/1992 Stannis ..... B60R 7/02 211/175
5,205,420 A * 4/1993 Petryszak ..... A47B 65/20 211/43
5,325,792 A * 7/1994 Mulloy ..... A47B 65/20 108/28
5,338,108 A 8/1994 Hunt et al.
5,740,926 A * 4/1998 Mulloy ..... A47B 57/585 211/43
6,024,241 A 2/2000 Keillor
6,272,727 B1 8/2001 Fish
6,515,590 B1 * 2/2003 Lauria ..... A47B 65/00 340/692
6,974,041 B2 * 12/2005 Salemi ..... A47B 57/585 211/43
7,178,885 B2 2/2007 Berkson et al.
9,107,497 B1 * 8/2015 Al-Habsi ..... A47B 65/10
9,238,546 B1 * 1/2016 Burkholder ..... G11B 33/0461

FOREIGN PATENT DOCUMENTS

GB 181776 6/1922
WO 8102829 10/1981

* cited by examiner

RECORD HOLDER SYSTEM AND METHOD

TECHNICAL FIELD

The invention generally relates to organizers for records, and more particularly relates to a holder system and method for maintaining records, as well as books and similar objects, in upstanding and organized manner.

BACKGROUND

Vinyl records are historically a desired form of recorded media, and there has been a recent resurgence in collecting and favoring such media. Vinyl records typically are containable in rectangular cardboard sleeves. The sleeves often include text and graphics. The spines of the sleeves have often included musical band/entertainer and album names for each record. These records, and other similar flat books and other objects, often are stacked in various manners. The stacking has not been ideal because often organization of the stacking has been limited and stacking may lead to warp of stacked items or other damage. Also, organizational devices for records have often been limited in ability to vary according to sizing of collections and similar dimensional aspects.

It would be a significant improvement in the art and technology to provide organization devices for records and other items. It would also be an improvement for such devices to permit variable capacity for items. It would also be an improvement for display of items in desirably oriented manner. It would moreover be an improvement for particular orientation of organized items that will help retain and protect integrity of the items.

SUMMARY

An embodiment of the invention is a system including a chassis, a track connected to the chassis, a fixed end fixedly connected to the chassis and the track, and an adjustable end selectively slidably connected to track and guided by the chassis.

Another embodiment of the invention is a record holder system including a frame of two ends and two sides, a fixed end attached to one of the ends of the frame, and a selectively adjustable end slidably connected to the frame.

Yet another embodiment of the invention is a method. The method includes forming a chassis of two ends and two sides, connecting a fixed end to one of the ends of the chassis, connecting a track to the chassis, and connecting an adjustable end to the track.

BRIEF DESCRIPTION OF THE DRAWINGS

The present invention is illustrated by way of example and not limitation in the accompanying figures, in which like references indicate similar elements, and in which.

DETAILED DESCRIPTION

Figure 1:
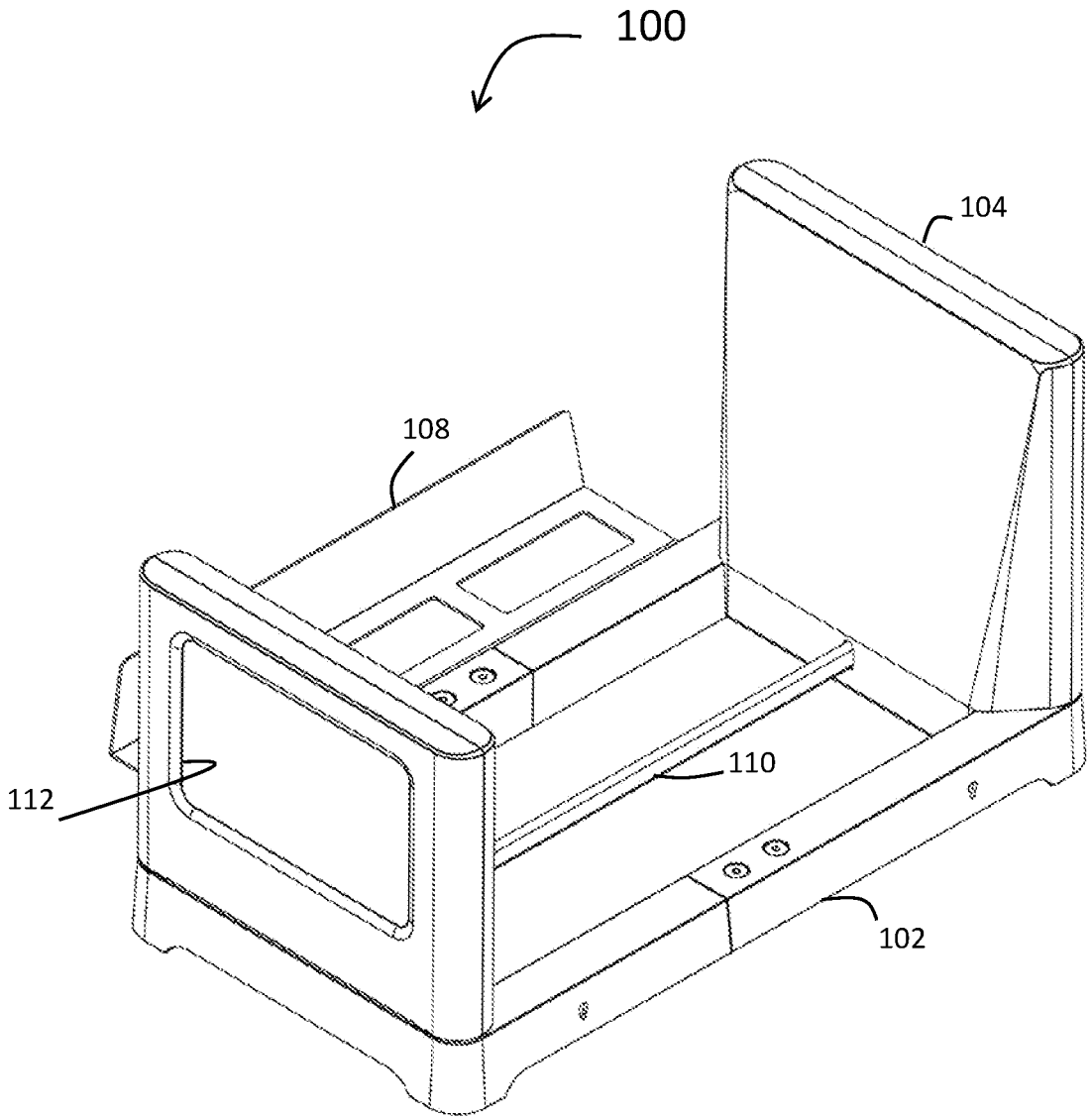
FIG. 1 illustrates a top and right side perspective view of a system of an adjustable end and a fixed end for retaining items, according to certain embodiments of the invention.

Referring to FIG. 1, a system 100 includes a chassis 102. A fixed end 104 is connected to an extent of the chassis 102. An adjustable end 106 is also connected to the chassis 102 for slidable interaction therewith. The chassis 102 mediately connects to a track 110. The adjustable end 106 is slidably connected to the track 110 and engageable with the track 110 to retain the adjustable end 106 in relation to the fixed end 104. A shelf 108 is connected extending from a side of the chassis 102 along travel of the adjustable end 106. The adjustable end 106 may include an indention 112 in a side opposite the fixed end 104.

Figure 2:
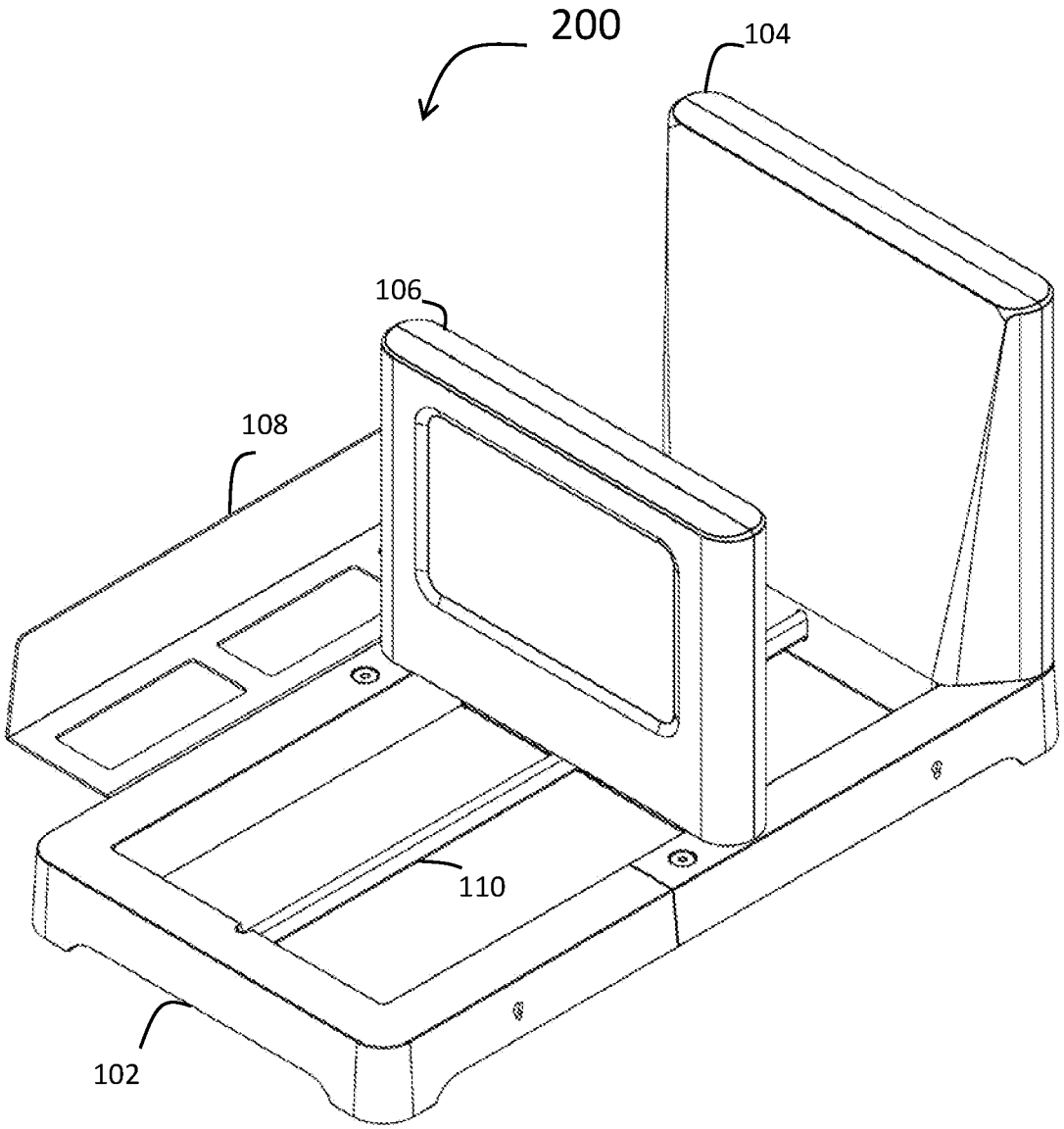
FIG. 2 illustrates a top and right side perspective view of a system of an adjustable end and a fixed end, with varied positioning of the adjustable end, according to certain embodiments of the invention.

Referring to FIG. 2, a system 200 includes the chassis 102 connected to the fixed end 104 and the track 110. The adjustable end 106 is slid along the track 110 toward the fixed end 104, to a mediate location along extent of the chassis 102. The adjustable end 106 includes a gripper (not shown in detail) which selectively is engageable to the track 110. In this manner, the adjustable end 106 may be lodged in relatively fixed engagement along travel of the track 110. This allows the spacing between the fixed end 104 and the adjustable end 106 to be varied as desired, and also allows the adjustable end 106 to be selectively stopped and retained at desired spacing from the fixed end 104.

In operation, the adjustable end 106 is located along the track 110 in desired spacing relation to the fixed end 104. Record albums, or other items, may be retained (such as, for nonexclusive example, in upright position) between the fixed end 104 and the adjustable end 106. The adjustable end 106 is moveable to desired spacing location relative to the fixed end 104, and then engages to the track 110 to retain the spacing between the adjustable end 106 and the fixed end 104.

Figure 3:
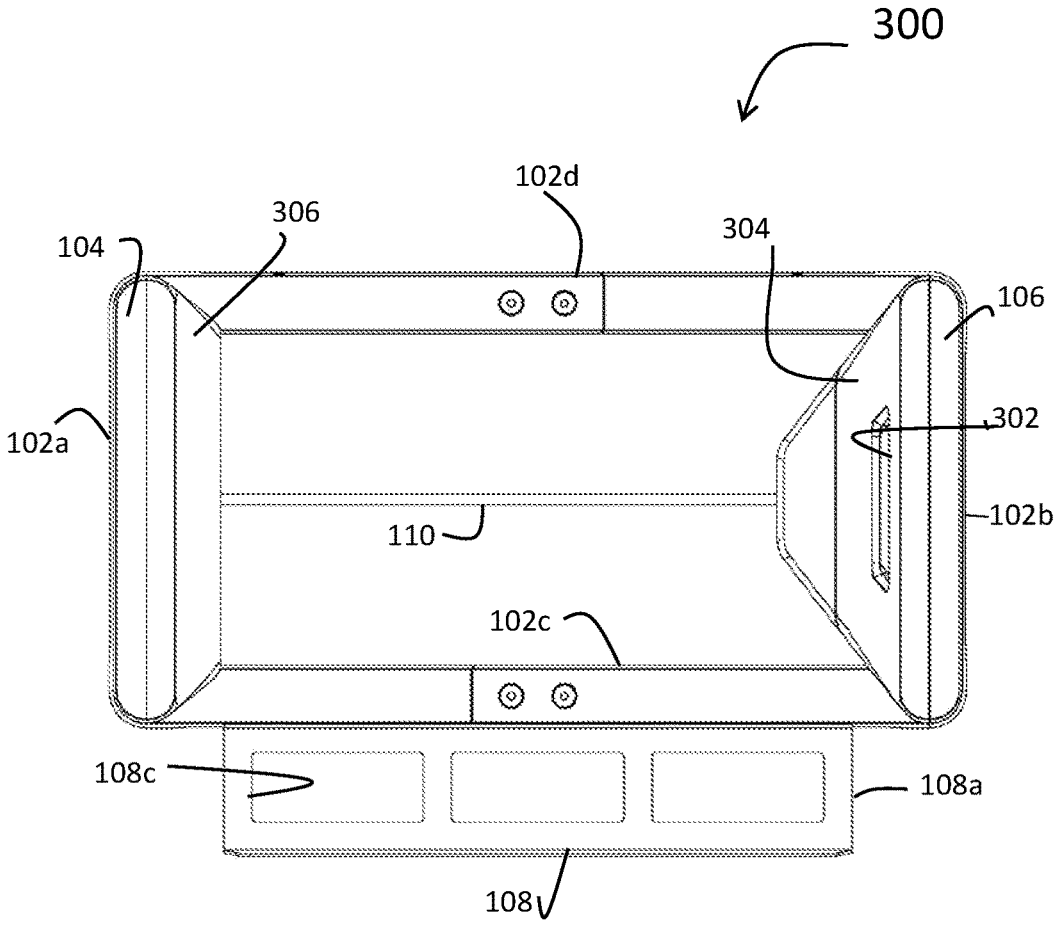
FIG. 3 illustrates a top view of a system of an adjustable end and a fixed end with the adjustable end distanced from the fixed end, according to certain embodiments of the invention.
Figure 4:
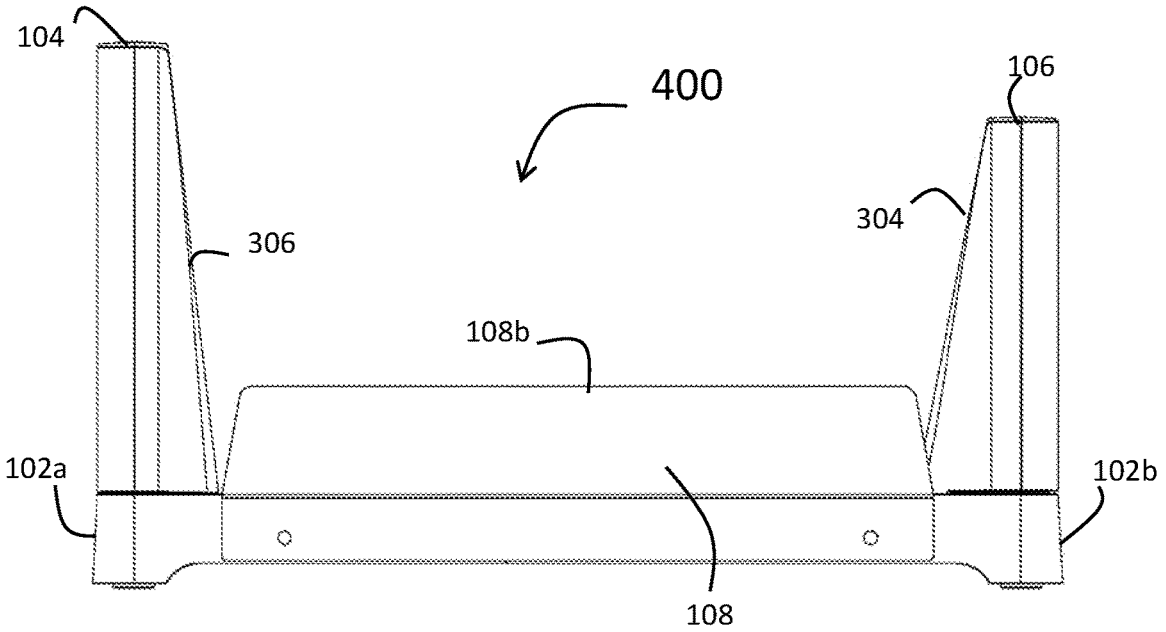
FIG. 4 illustrates a left side view of a system of an adjustable end and a fixed end with the adjustable end distanced from the fixed end, according to certain embodiments of the invention.
Figure 5:
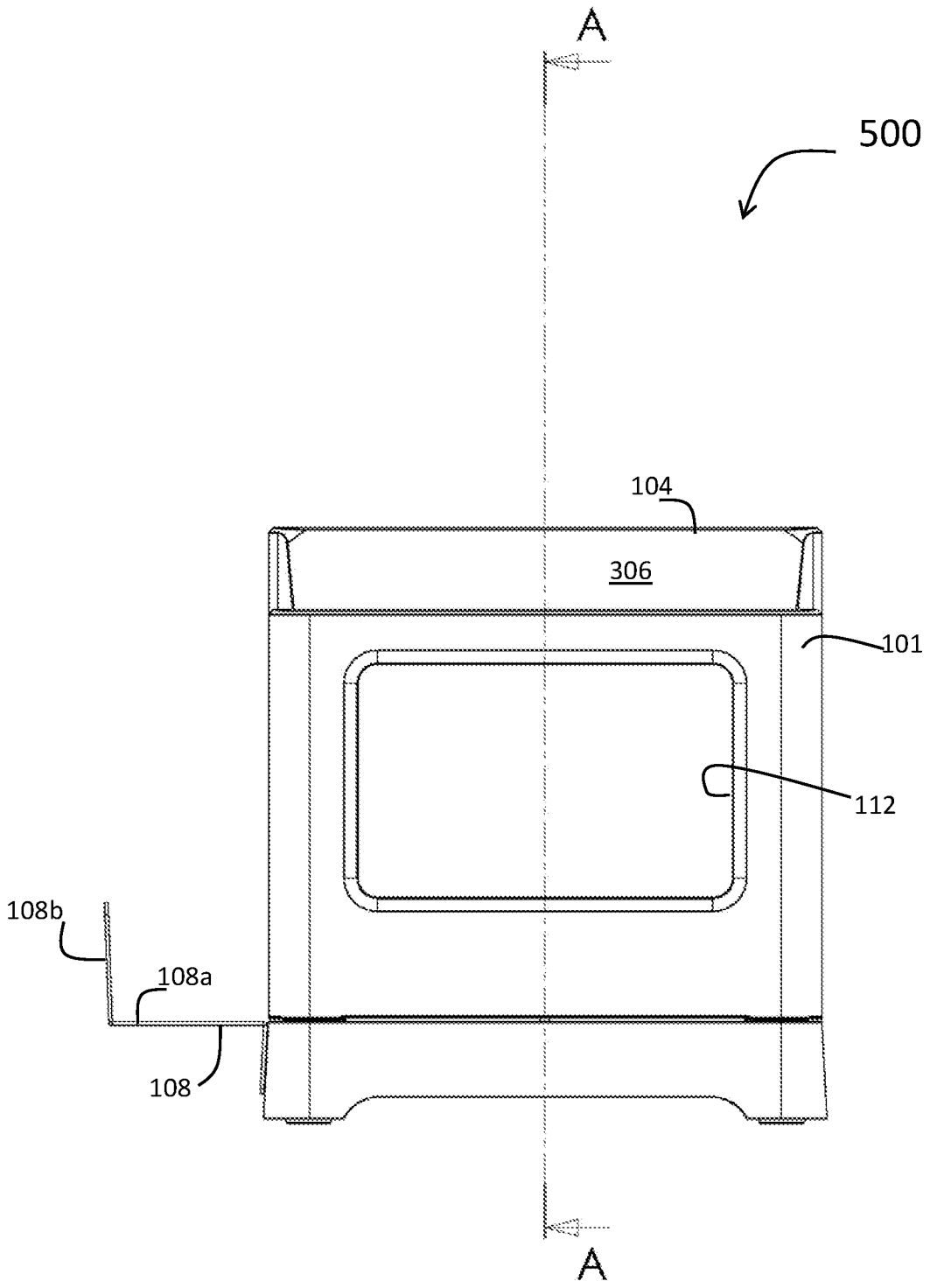
FIG. 5 illustrates an end view of a system towards an outer side of an adjustable end and viewed towards an angled face of a fixed end, according to certain embodiments of the invention.

Referring to FIGS. 3-5, in conjunction with FIGS. 1 and 2, the chassis 102 includes a back edge 102*a* and a front edge 102*b*. The back edge 102*a* and the front edge 102*b* are substantially parallel in relation, and each extends laterally about the lateral dimension of the fixed end 104 and the adjustable end 106, respectively. The back edge 102*a* and the front edge 102*b* are connected by a right side 102*d* and a left side 102*c*. The right side 102*d* and the left side 102*c* are substantially parallel and connect extents of the back edge 102*a* and the front edge 102*b*. The track 110 is connected mediately to the back 102*a* and the front edge 102*b*, intermediate to the right side 102*d* and the left side 102*c*.

The fixed end 104 and the adjustable end 106 are each connected substantially perpendicular to the chassis 102 (i.e., raised from the chassis 102). The adjustable end 106 may extendingly raise shorter from the chassis 102, than the fixed end 104, although this is not necessary in all embodiments. The shelf 108 is connected to and extends along the left side 102*c* at least a portion of the left side 102*c*. The shelf 108 includes a lateral extension 108*a* and an upstanding side 108*b*. The shelf 108 may be selectively serrated 108*c*.

The fixed end 104 includes a downward slope on an angled face 306 that extends towards the adjustable end 106. The adjustable end 106 also includes a sloped face 304 extending at angle downwards facing the fixed end 104. In the downward slope of the angled face 306, near a top of the adjustable end 106, the adjustable end 106 includes a handle 302 for actuating the adjustable end 106 for release from engagement with and moving along the track 110.

In operation, the adjustable end 106 is gripped at the handle 302 and the handle 302 is depressed inward to the adjustable end 106. The depressed handle 302 releases the adjustable end 106 from grip to the track 110. The adjustable end 106 is slid along the track 110 to desired displacement of the adjustable end 106 from the fixed end 104 along the track 110. The indentation 112 may aid the grip of the handle 302.

Records or other items may be stacked upright between the fixed end 104 and the adjustable end 106, either before or after the adjustable end 106 is selectively positioned along the track 110. For non-exclusive example, records (not shown) may be positioned upright against the fixed end 104. The adjustable end 106 may then be moved, by depression of the handle 302, along the track 110 to abut the records. The shelf 108 retains the records or other items in lateral position with respect to the chassis 102. The abutting adjustable end 106 in cooperation with the fixed end 104 situates the records or other items in upright position, such as for display, storage or other purpose.

Figure 6:
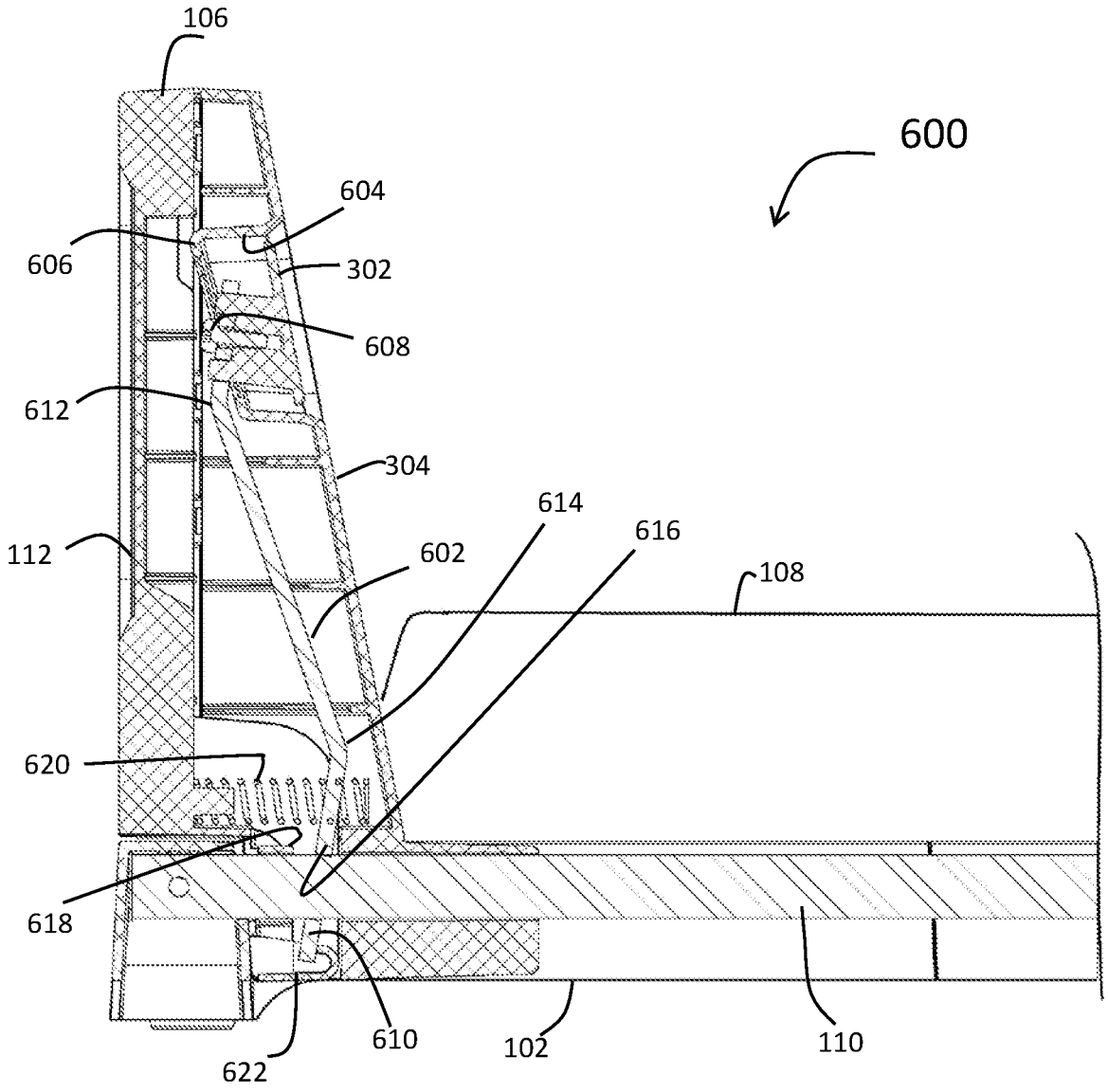
FIG. 6 illustrates a partial cross-section of a system of an adjustable end taken along line A-A' of FIG. 5, according to certain embodiments of the invention.

Referring to FIGS. 5 and 6, in conjunction with FIGS. 1-4, a partial cross section along line A-A' of FIG. 5 shows in detail in FIG. 6 a clamp 602 of the adjustable end 106 connected to the handle 302. The handle 302 is located in a depression 604 formed in the sloped face 306 of the adjustable end 106. A shield 606 tends the handle 302 outward in the depression 604. The bias of the shield 606 on the handle 302 is overcome by manually depressing the handle 302 inwards to the adjustable end 106.

The handle 302 connects by a pin 608 to the clamp 602. The clamp 602, for non-exclusive example, is a strut 610 that is bent in opposing directions 612, 614 towards respective extents. The strut 610 includes a hole 616 towards an end opposing the handle 302. The hole 616 is sized to accommodate the track 110 of the chassis 102, and somewhat larger to allow crimp on the track 110 and release from crimp when the handle 302 is depressed.

The strut 610 passes through a throughway 618 in the bottom of the adjustable end 106. The throughway 618 is sized to allow the strut 610 to move with respect to the track 110, sufficient to permit engagement and disengagement crimp of the strut 610 to the track 110 when the handle 302 is positioned outward and inward, respectively. Next to the bend 614, a finger 622 is connected to the adjustable end 106 and engages an end of the strut 610 opposite the handle 302.

At extent of the strut 610 opposite the handle 302, the strut 610 abuts the finger 622 counter to the spring 620. The spring device 622 retains the strut 610 in position disengaged from the track 110 when the handle 302 is pressed to move the adjustable end 106. Sides of the throughway 618 engage the track 110 when the handle 302 is in non-depressed state, in order to crimp the track 110 and retain the adjustable end 106 in position along the track 110. Sides of the throughway 618 disengage the track 110 when the handle 302 is pressed, in order to disengage crimp of the track 110 and allow repositioning of the adjustable end 106 along the track 110 and in desired relation to the fixed end 104.

In operation, the chassis 102 sits on a surface, such as a table top, floor, or other surface. The adjustable end 106 and the fixed end 104 project upward. Records or other items are stacked upright against the fixed end 104, along space between the fixed end 104 and the adjustable end 106. Records, as non-exclusive example, may rest on a side against the shelf 108. The handle 302 of the adjustable end 106 is manually pressed, thereby declamping the adjustable end 106 from engagement with the track 110. The adjustable end 106 is moved along the track 110 to abut the records or other items on opposing face/side from the fixed end 104. When the adjustable end 106 is so positioned, the handle 302 is released and the clamp 602 of the adjustable end 106 engages the track 110 to retain the adjustable end 106 in position.

Figure 7:
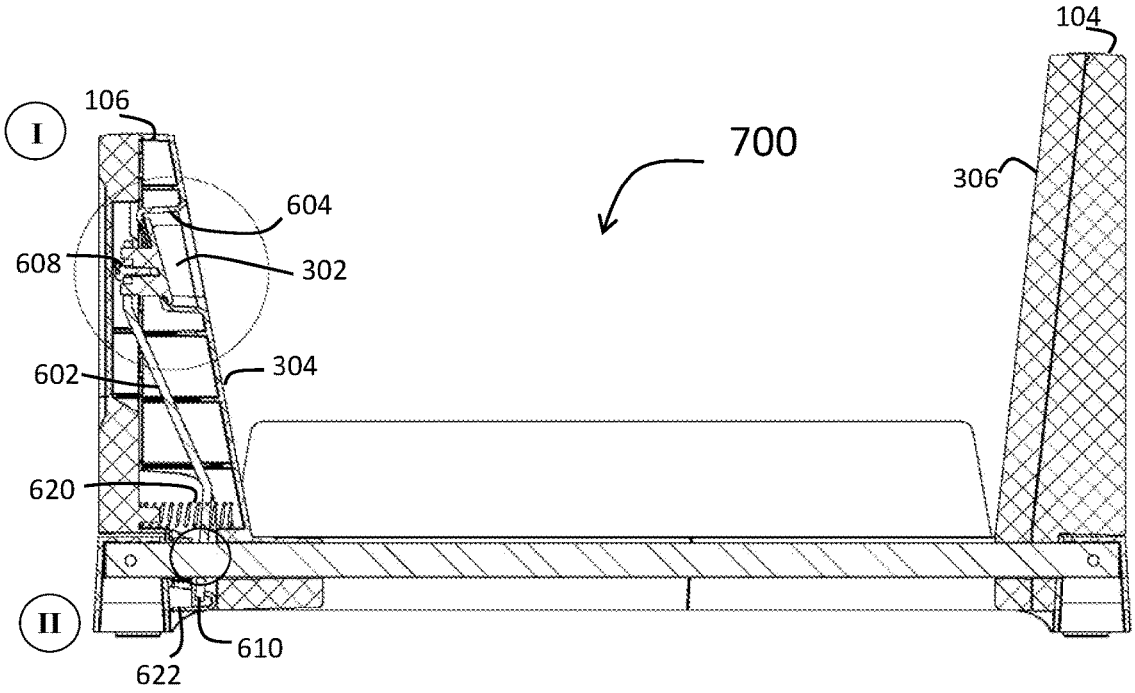
FIG. 7 illustrates a right side view cross-section of a system of an adjustable end, a fixed end, and a chassis, as well as a track, according to certain embodiments of the invention.
Figure 8:
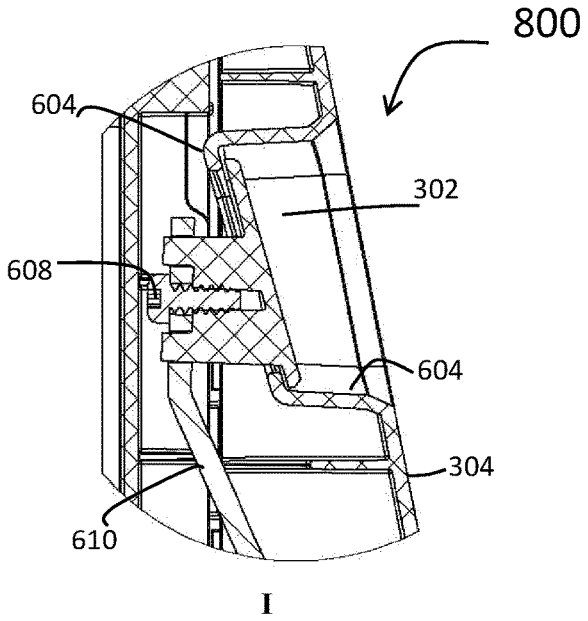
FIG. 8 illustrates a detail cross-section view of a portion "I" of a system of an adjustable end of FIG. 7, according to certain embodiments of the invention.
Figure 9:
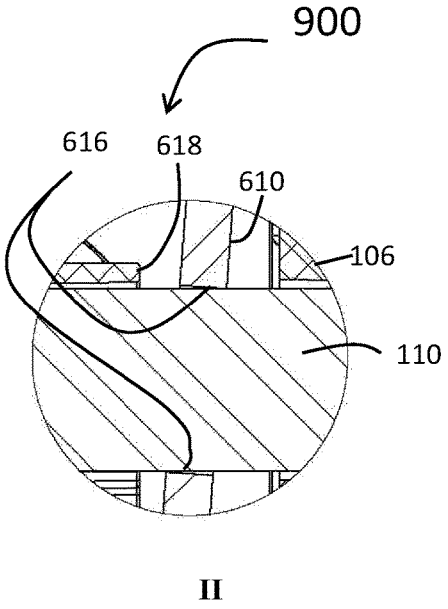
FIG. 9 illustrates a detail cross-section view of a portion "II" of a system of an adjustable end of FIG. 7, according to certain embodiments of the invention.

Referring to FIGS. 7-9, in conjunction with FIGS. 1-6, details of the clamp 602 show the handle 302 with pin 608 connection to the strut 610. The shield 606 deflects the handle 302 to an outwardly directed position within the depression 604 of the sloped face 304. The spring 620 biases the strut 610 towards the sloped face 304. The spring 622 of the adjustable end 106 retains the strut 610 in position along the track 110 passing in the throughway 618.

In operation, the handle 302 remains biased outward in the depression 604 unless and until depressed. The spring 620 causes friction along the track 110 where the sides of the hole 616 contact the track 110, unless and until the handle 302 is depressed. When the handle 302 is depressed, the strut 610 moves slightly away from direction of the sloped face 304. This causes the hole 616 to reposition for sliding passage of the strut 610 along the track.

Referring to FIG. 9, in conjunction with FIGS. 1-8, the strut 610 is clampingly engaged to the track 110. On press of the handle 302, the strut 610 moves (to left in the figure) to move the hole 616 more substantially into surrounding of the track 110. Thus, clamping engagement of the strut 610 to the track 110 is reduced and the adjustable end 106 may be slid along the track 110 for positioning with respect to the fixed end 104.

Figure 10:
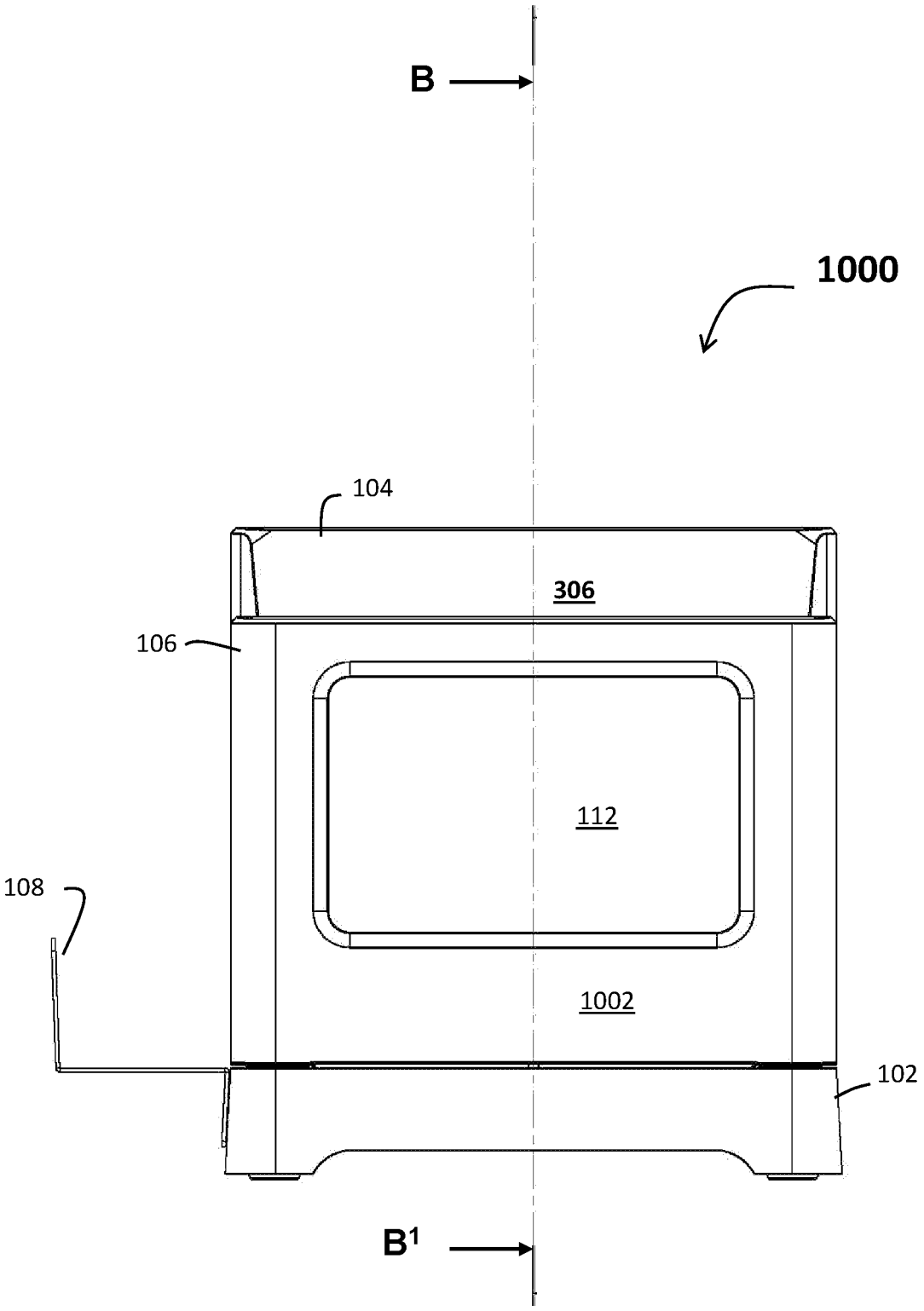
FIG. 10 illustrates an end view of a system towards an outer side of an adjustable end and viewed towards an angled face of a fixed end, according to certain embodiments of the invention.
Figure 11:
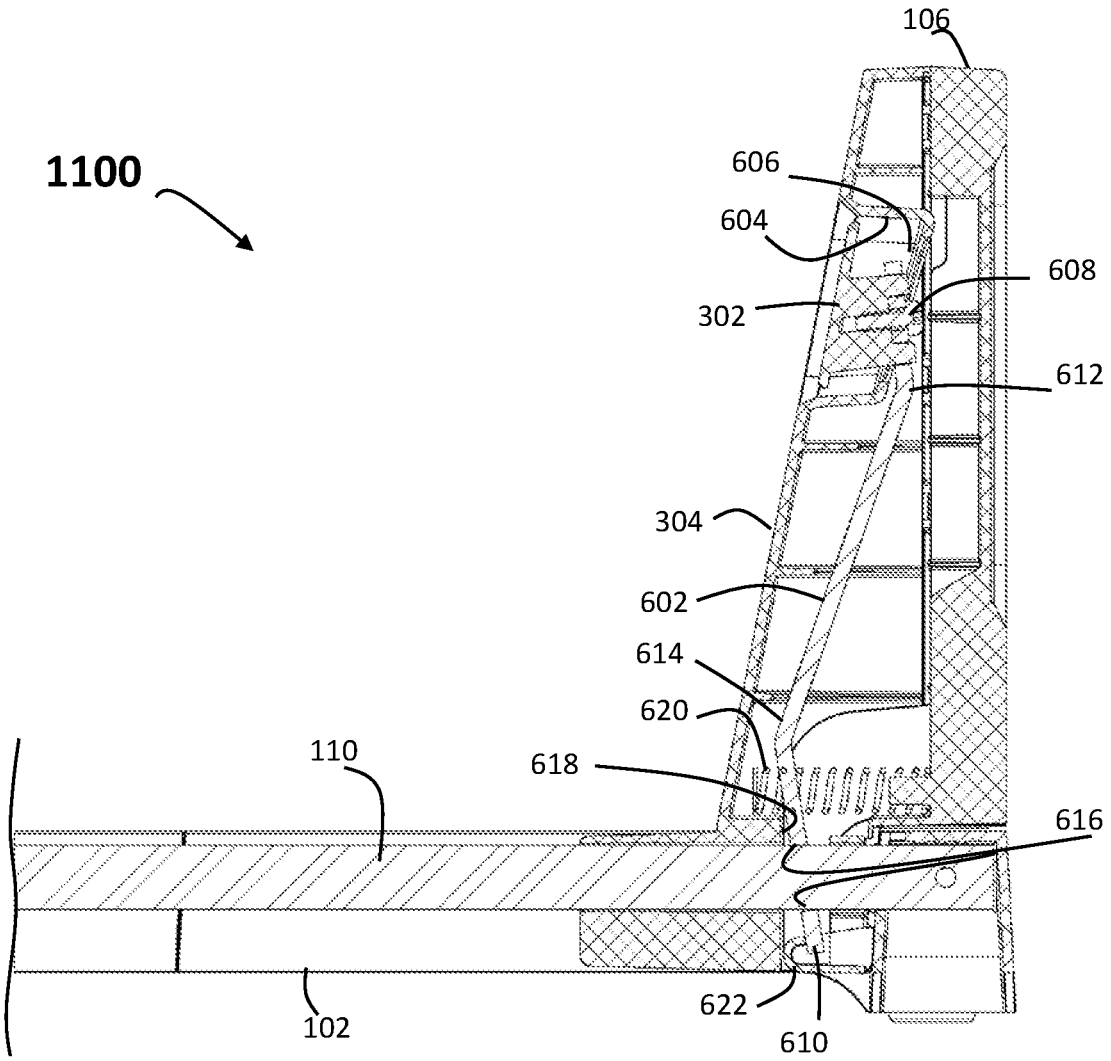
FIG. 11 illustrates a partial cross-section of a system of an adjustable end taken along line B-B' of FIG. 10, according to certain embodiments of the invention.

Referring to FIGS. 10 and 11, in conjunction with FIGS. 1-9, an outward side 1002 of the adjustable end 106 opposite the sloped face 304 includes the indention 112. The outward side 1002 rises relatively perpendicular to the chassis 102. The top of the adjustable end 106 is relatively planar and perpendicular to the outward side 1002. The sloped face 304 extends at angle to near the track 110 and slidingly connects to the chassis 102 as guide.

The clamp 602 of the adjustable end 106 is connected to the handle 302. The handle 302 is within the depression 604 in the sloped face 306. The handle 302 is biased outward in the depression 604 when the clamp 602 engages the adjustable end 106 to the track 110. When the handle 302 is pressed inward in the depression 604, the clamp 602 disengages from the track 110 and the adjustable end 106 may be slid along the track 110 and guided by the chassis 102.

The clamp 602 includes the strut 610. The strut 610 includes the opposing bends 612, 614. The spring 620 engages the strut 610 to bias the strut 610, and by consequence the handle 302, outward in the depression 604 and with the strut 610 engaging the track 110. The strut 610, when engaged to the track 110 in such manner, retains the adjustable end 106 in position along the track 110.

Press of the handle 302 into the depression 604 pushes and slightly deforms the strut 610 against the finger 622. This disengages the clamp 602 of the adjustable end 106 to the track 110, and allows the adjustable end 106 to be slid along the track 110 guided by the chassis 110. When the handle 302 is not pressed, the spring 620 biases the strut 610 against the finger 622 and sides of the hole 616 engage the track 110 to restrict movement of the adjustable end 106 along the track 110 and chassis 102.

In operation, the chassis 102 sits on a surface. The adjustable end 106 and the fixed end 104 project upward from the chassis 102. Records or other items are placed upright against the fixed end 104 between the fixed end 104 and the adjustable end 106. The shelf 108 can retain the records in uniformity along edges. The handle 302 of the adjustable end 106 is manually pressed to disengage the adjustable end 106 from engagement with the track 110 to allow the adjustable end 106 to be slid along the track 110 as guided by the chassis 102. The adjustable end 106 when so disengaged is moved along the track 110 to abut and stack the records between the fixed end 104 and the adjustable end 106. Release of press of the handle 302 clamps the adjustable end 106 to the track 110 to retain the adjustable end 106 in position relative to the fixed end 104.

As will be understood, wide variation is possible in the foregoing embodiments. Various clamping devices are possible in the adjustable end. Further, the sloped or angled faces of the respective ends may be differently configured, such as for non-exclusive example, the faces may be relatively perpendicular to the chassis and track. The handle can be located in other positions in the adjustable end. Variety of surface elements are possible in faces and sides of the ends. A variety of materials and manners of manufacture are possible in the embodiments, including, but not limited to, plastic, metal, polymer, wood, and others, and various elements may be formed of different or same materials, and manufacture may include, but is not limited to, molding, gluing, attaching, and others.

In the foregoing, the invention has been described with reference to specific embodiments. One of ordinary skill in the art will appreciate, however, that various modifications, substitutions, deletions, and additions can be made without departing from the scope of the invention. Accordingly, the specification and figures are to be regarded in an illustrative rather than a restrictive sense, and all such modifications substitutions, deletions, and additions are intended to be included within the scope of the invention. Any benefits, advantages, or solutions to problems that may have been described above with regard to specific embodiments, as well as device(s), connection(s), step(s) and element(s) that may cause any benefit, advantage, or solution to occur or become more pronounced, are not to be construed as a critical, required, or essential feature or element.

What is claimed is:

1. A system, comprising:

a chassis;

a guide track connected to the chassis;

a fixed end fixedly connected to the chassis and the guide track; and an adjustable end selectively slidably connected to track and guided by the chassis a handle;

a clamp of the adjustable end selectively disengageable from the guide track; and a strut connected to the handle;

wherein the chassis is rectangular and includes a first end and a second end connected by side rails;

wherein the guide track is mediately connected to the first end and the second end;

wherein the clamp selectively engages the guide track to retain the adjustable end in relative position to the fixed end;

wherein the strut includes a hole for passage of the guide track.

2. The system of claim 1, wherein the handle is biased and the strut engages the guide track when the handle is biased.

3. The system of claim 2, wherein the handle when pressed overcomes the bias and disengages the strut from the guide track.

4. The system of claim 3, further comprising:

a spring connected to the strut and the adjustable end for biasing the handle and to engage the strut to the guide track.

5. A record holder system, comprising:

a frame of two ends and two sides;

a fixed end attached to one of the ends of the frame; and a selectively adjustable end slidably connected to the frame;

a guide track connected to the ends;

a clamp of the adjustable end slidably connected to the guide track, the clamp is biased to engage the guide track; and a shelf connected to one of the sides of the frame;

wherein the clamp includes a strut connected to the handle, the strut includes a hole for passage of the guide track, and sides of the hole engage the track when the lever is not pressed.

6. The system of 5, wherein press of the lever disengages the sides of the hole of the strut from the guide track.

* * * * *